US005418331A

United States Patent [19]

Delalle

[11] Patent Number: 5,418,331

[45] Date of Patent: May 23, 1995

[54] ELECTRICAL CONNECTOR

[75] Inventor: Jacques Delalle, Triel, France

[73] Assignee: Raychem SA, France

[21] Appl. No.: 193,137

[22] PCT Filed: Sep. 3, 1992

[86] PCT No.: PCT/GB92/01606

§ 371 Date: Feb. 14, 1994

§ 102(e) Date: Feb. 14, 1994

[87] PCT Pub. No.: WO93/05546

PCT Pub. Date: Mar. 18, 1993

[30] Foreign Application Priority Data

Sep. 3, 1991 [GB] United Kingdom ..... 9118841

[51] Int. Cl.[6] ..... H01R 4/22

[52] U.S. Cl. ..... 174/87; 174/74 R; 174/84 C; 174/94 R; 174/DIG. 8; 439/730; 439/874; 439/882; 439/936

[58] Field of Search ..... 174/87, 84 C, 76, 74 R, 174/94 R, DIG. 8; 439/730, 874, 882, 936

[56] References Cited

U.S. PATENT DOCUMENTS

| | | | |
|---|---|---|---|
| 2,792,560 | 5/1957 | Bollmeier | 174/74 R |
| 3,656,092 | 4/1972 | Swengel, Sr. et al. | |
| 3,732,528 | 5/1973 | Vetter . | |
| 4,123,133 | 10/1978 | Pickett . | |
| 4,553,809 | 11/1985 | Holt | 174/84 R |
| 4,647,717 | 3/1987 | Uken | 174/84 C |
| 4,889,506 | 12/1989 | Connolly et al. | 439/874 |
| 5,086,967 | 2/1992 | Delalle et al. | 228/56.3 |
| 5,118,313 | 6/1992 | Delalle | 439/730 |
| 5,151,239 | 9/1992 | King, Jr. | 264/274 |
| 5,221,815 | 6/1993 | Bostock et al. | 174/84 R |
| 5,331,113 | 7/1994 | Soni et al. | 174/87 |

FOREIGN PATENT DOCUMENTS

| | | | |
|---|---|---|---|
| 0432662 | 6/1991 | European Pat. Off. . | |
| 1062783 | 8/1959 | Germany | 174/84 R |
| 755557 | 8/1956 | United Kingdom . | |
| 822189 | 10/1959 | United Kingdom . | |
| 1077700 | 8/1967 | United Kingdom | 174/84 R |
| 1240976 | 7/1971 | United Kingdom . | |
| WO87/05447 | 9/1987 | WIPO . | |
| WO88/09068 | 11/1988 | WIPO . | |
| WO90/00819 | 1/1990 | WIPO . | |

*Primary Examiner*—Morris H. Nimmo
*Attorney, Agent, or Firm*—Sheri M. Novack; Herbert G. Burkard

[57] ABSTRACT

An electrical terminal (1) for connection to one or more electrical wires comprises a conventional terminal portion (2) having a lug portion (3) and a hollow shank (4), a jacket (11) of polymeric insulation that extends over the shank, and a tapering hollow connection piece (6) for example in the form of a coiled wire. The tapering connection piece has an internal and external screw thread and is arranged partly within the end of the shank. It is capable of receiving one or more electrical wires so that they can be secured within the connection piece (6), and the connection piece (6) can be secured within the shank (5) by twisting the terminal about the wires. The jacket (11) is preferably formed from a heat-shrinkable sleeve, and the terminal preferably includes a quantity of solder (9) for forming a permanent electrical connection.

11 Claims, 1 Drawing Sheet

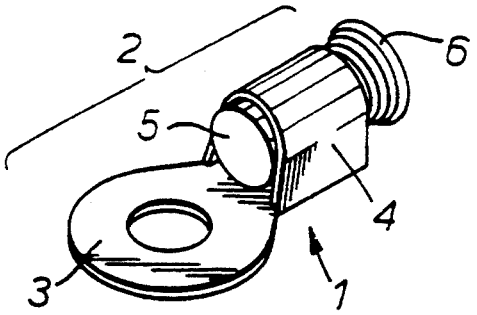
Fig. 1.
Fig. 2.
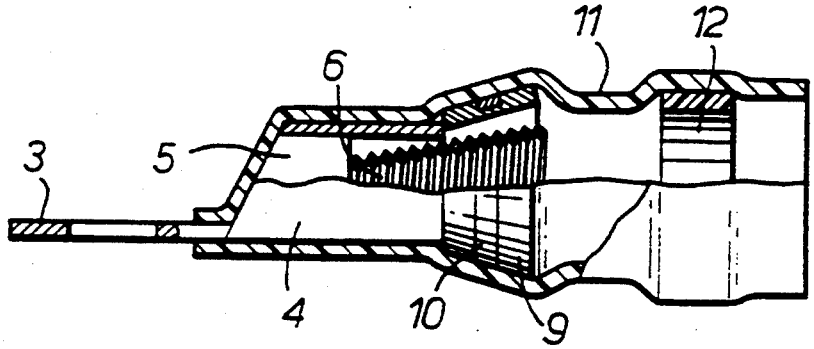
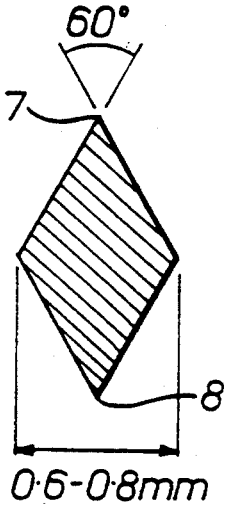
Fig. 3.
Fig. 4.
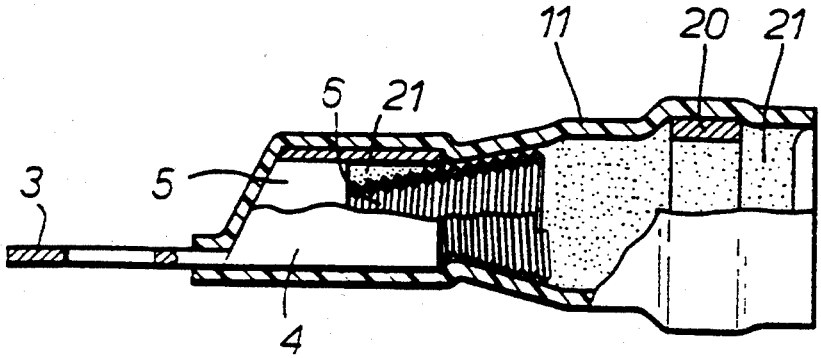

ELECTRICAL CONNECTOR

This invention relates to electrical connectors and especially to electrical terminals for forming a connection between one or more electrical wires and a further, fixed, electrical terminal for example a screw terminal.

A number of terminals for wires have been proposed in which a shank of the terminal is crimped about the end of a wire after stripping the wire of insulation. One such terminal, for example, is described in our international patent application No. WO90/00819. In addition, it has been proposed to manufacture terminals in which the shank is connected to the wire by means of solder for example using a solder ring located within a dimensionally heat-recoverable sleeve.

These terminals suffer from the disadvantage that they have relatively little tolerance to the size of wire to be terminated, with the result that one must employ a large number (usually at least four) different sizes of terminals for each range of wires or cables to be terminated, especially in the case of crimp terminals. While terminals employing a solder connection are usually quite satisfactory as concerns electrical continuity they often do not exhibit sufficient resistance to tensile strain. Furthermore, such terminals are often not easily employable with solid conductor wires.

According to the present invention, there is provided an electrical terminal for connection to one or more electrical wires, which comprises a terminal portion having a lug portion and a hollow shank, a jacket of polymeric insulation that extends over the shank, and a tapering hollow connection piece that has an internal and an external screw thread, the connection piece being arranged partly within the end of the shank and being capable of receiving one or more electrical wires so that the wire or wires can be secured within the connection piece and the connection piece can be secured within the shank by twisting the terminal about the wire or wires.

Thus, by means of the present invention it is possible to terminate one or more than one wires at a single terminal where the wire gauges vary significantly, and produce a termination with relatively low electrical resistance and high tensile strength.

The connecting element may, if desired, by formed from a solid block of metal that has been tapped both internally and externally with a screw thread. However it is preferred, both in terms of ease of manufacture and effectiveness in use, to employ a metal wire that has been wound into a tapering helix, preferably a frustoconical helix. Such a form of connection piece has the advantage that it will be locked in position in the end of the terminal shank as the wire or wires are screwed into it in a similar manner to a nut mounted within a bolt. The wire may be formed with a circular cross-section, although it is preferred for the wire to have a relatively sharp ridge along its length, eg. formed by cold drawing or cold rolling, which, when the wire has been coiled, is directed toward the interior of the coil in order to form the screw thread. In particular it is advantageous for the wire to be formed with a polygonal, and especially a square or diamond-shaped, cross-section. The wire may be formed from any appropriate metal or metal alloy, but preferably is formed from copper, and especially from copper having substantially the same purity as that conventionally employed for electrical conductors.

The insulating jacket is preferably at least partially dimensionally recoverable and especially dimensionally heat-recoverable, that is to say, it has a dimensional configuration that may be made to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, eg. with alpha olefins such as 1-butene or 1-hexene, or vinyl acetate, polyamides or fluorpolymers, eg. polytetrafiuoroethylene, vinylidine fluoride or ethylenetetrafluoroethylene copolymer.

The jacket preferably extends not only over the shank of the termination but also beyond the end of the shank into which the wire or wires will be introduced so that it encloses the connection piece and the proximal end regions of the wire or wires thus providing electrical insulation for the metallic elements in the termination and aiding the resistance to moisture ingress.

The terminal is preferably provided with a quantity of sealant to prevent to reduce ingress of moisture into the shank from the region of the lug portion. Normally, the sealant will be provided as a gel or a fusible plastics insert. The term "gel" as used herein is intended to mean a liquid-extended polymer composition. Such compositions normally contain a three-dimensional network of cross-linked molecular chains and preferably include at least 300 parts, more preferably at least 500 parts by weight of extender liquid per 100 parts by weight of the polymer composition. The gel used in the invention preferably has a cone penetration value (measured by ASTM D217) within the range of from 100 to 400 $10^{-1}$ millimeters, more preferably 100 to 350 $10^{-1}$ millimeters; an ultimate elongation (measured by ASTM D412) preferably greater than 100%, with substantially elastic deformation to an elongation of preferably at least 100%; and ultimate tensile strength (ASTM D412) preferably less than 1 MegaPascal.

The polymer composition may for example comprise an elastomer, or a block copolymer having relatively hard blocks and relatively elastomeric blocks. Examples of such copolymers include styrene-diene block copolymers, for example styrene-butadiene or styrene-isoprene diblock or triblock copolymers, or styrene-ethylene-butylene-styrene triblock copolymers as disclosed in international patent publication number WO88/00603. The extender liquids employed in the gel preferably comprise oils conventionally used to extend elastomeric materials. The oils may be hydrocarbon oils, for example paraffinic or naphthenic oils, synthetic oils for example polybutene or polypropene oils, and mixtures thereof. The preferred oils are mixtures of non-aromatic paraffins and naphthenic hydrocarbon oils. Suitable gels can also be prepared by curing reactive silicones with non-reactive extender silicones. The gel may contain known additives such as moisture scavengers (eg. benzoyl chloride), antioxidants, pigments and fungicides.

Where the sealant is provided in the form of a fusible plastics insert it may be located in an end portion of the jacket that is positioned over the end of the shank, or it may be located within the shank itself so that it will melt and block the shank when the terminal is heated.

The fusible plastics insert is preferably one formed from an olefin homo- or copolymer with other olefins, or ethylenically unsaturated monomers, eg. high, medium or low density polyethylene and ethylene copolymers with alpha olefins especially $C_3$ to $C_8$ alpha olefins, vinyl acetate or ethyl acrylate; polyamides, polyesters, halogenated polymers and the like. Preferred polyamides include those polyamides having an average at least 15 carbon atoms between amide linkages for example those based on dimer acids and/or dimer diamines. Examples of such adhesives are given in U.S. Pat. Nos. 4,018,733 to Lopez et al and 4,181,775 to Corke et al. Preferred polyesters include polybutylene terephthalate and butylene ether butylene terephthalate block copolymers.

The insulating jacket will normally extend beyond the end of the shank remote from the lug portion and will contain a further quantity of sealant to prevent or reduce ingress of moisture into that end of the shank. The sealant may comprise a gel or an insert of fusible plastics material as described above, and a combination of both forms of sealant my be employed at different ends of the insulating jacket.

Where a gel is used as a sealant it is appropriate to employ some means of keeping it in compression during service. Thus, for example, the insulating jacket may include a metal ring that can be crimped about any wires that are inserted in the termination in order to maintain the gel under compression and to assist in strain relieving the wire or wires when bent.

If desired a permanent solder connection may be formed by including a quantity of solder in the termination. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, eg. $Sn_{96.5}Ag_{3.5}$ eutectic will provide a visual indication that the device has been heated sufficiently to melt the lower melting point composition and to form a satisfactory solder joint. If desired the lower melting point solder may be a non-eutectic composition and, for example as described in International Application No. PCT/GB90/00234, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the stranded conductors, which can be caused by prolonged heating of the device.

The solder may be positioned anywhere where it will be able to flow into the connecting .element to fore a solder joint. The solder may be employed in the fore of a ring or in any other fore for example a ball, and may be disposed symmetrically about the sleeve axis or offset from it. The solder element may, for instance, be located at the smaller diameter end of the connecting element in which case it may be in the form of a ball or plug, or it my be located in the region of a large diameter end of the connecting element, for example in the form of a ring. Preferably the solder is in the from of an element that surrounds the connecting element, especially where the connecting element is in the fore of a coil so that the fused solder can flow through the windings of the coil to the interior thereof. In the case of connecting elements formed from solid blocks of metal, it is advantageous to provide the connecting element with one or more holes around its periphery to allow fused solder to flow into the interior of the connecting element.

The particular form of the lug portion does not fore part of the invention and any conventional fore of lug may be employed.

Two forms of termination will now be described by way of example with reference to the accompanying drawings, in which:

FIG. 1 is an isometric view of a terminal and connecting piece employed in the present invention;

FIG. 2 is a side view, partly in section, of a terminal according to the invention;

FIG. 3 is a cross-section through the wire employed to form the connecting piece; and FIG. 4 is a side view, partly in section, of a second form of terminal according to the invention.

Referring to the accompanying drawings a terminal 1 comprises a conventional pressed copper or aluminium terminal portion 2 which comprises a lug 3 and a hollow open-ended shank 4 extending therefrom. A small insert 5 of fusible plastics material, for example polyethylene, is provided at the end of the shank nearest the lug for sealing the final termination against moisture ingress. A connection piece 6 formed as a frusto-conical spring or coil of hard temper copper wire is located in the end of the shank 4 remote from the lug 3 so that its smaller diameter end is enclosed within the shank while its larger diameter end is exposed. The copper wire has a diamond shaped cross-section as shown in FIG. 2 having two sharp ridges 7 and 8 and is coiled so that the ridges form an internal and an external screw thread on the connection piece 6. Accordingly the connection piece 6 can be located in the end of the shank 4 simply by screwing it into the open end until it is tight.

A band 9 of pre-fluxed $Sn_{63}Pb_{37}$ eutectic solder having a smaller band 10 of $Sn_{96.5}Ag_{3.5}$ high temperature solder is located over the exposed part of the connection piece 6, and a heat-recoverable sleeve 11 of transparent cross-linked polyvinylidine fluoride is partially recovered over the shank 4 and connection piece 6. The sleeve 11 extends beyond the end of the connection piece 6 for about half its length, and contains a fusible annular insert 12 formed from polyethylene.

In operation several electrical wires whose ends have been stripped of insulation can be inserted into the open end of the heat-recoverable sleeve 11 and into the end of the connection element 6 as far as possible. The terminal 1 is then twisted about the wires which has the effect of tightening the grip of the connection piece 6 on the wires and also of tightening the connection piece 6 within the shank 4 of the terminal. Finally the terminal is heated, for example by means of a hot-air gun or infrared lamp, by induction or by passing an electric current through the terminal to cause Joule heating. This causes the sleeve 11 to recover about the wires and the solder bands 9 and 10 to melts, flow between the windings of the connection element 6 and form a solder connection to the wires. At the same time the plastics inserts 5 and 12 melt and form a seal against water ingress at both ends of the sleeve 11.

The terminal my be employed with wires having a wide range of conductor cross-section, for example from 0.5 to 7 $mm^2$ which may have solid or stranded conductors or in which some wires have solid conductors and some stranded. Also the terminal may be fitted on a single wire.

A modification of the terminal is shown in FIG. 4. This terminal includes a terminal portion 2 having a lug 3 and shank 4, a connection piece 6, heat-recoverable sleeve 11 and fusible plastics insert 5 as described above with the exception that the sleeve 11 is formed from crosslinked nylon 11 or nylon 12 and has a thin adhesive lining. Also, the insert 5 has been fused before installation to seal the end of the sleeve 11 and the shank against water ingress. The terminal does not contain any solder but instead has a copper crimp ring 20 which may be crimped about the wire insulation in order to provide strain relief against bending of the wires. The sleeve 11 contains a quantity of a gel 21 that fills the entire internal cross-sectional area of the sleeve.

In operation the wire or wires are inserted into the open end of the sleeve 11 until they abut the internal surface of the connection piece 6, and the terminal is twisted about the wires as described above. The copper ring is then squeezed inwardly in order to put the gel 21 into compression and to provide the wires with strain relief. No heating of the terminal is necessary for installation.

I claim:

1. An electrical terminal for connection to one or more electrical wires, which comprises a terminal portion having a lug portion and a hollow shank, a jacket of polymeric insulation that extends over the shank, and a tapering hollow connection piece that has an internal and an external screw thread, the connection piece being arranged partly within the end of the shank and being capable of receiving one or more electrical wires so that the wire or wires can be secured within the connection piece and the connection piece can be secured within the shank by twisting the terminal about the wire or wires.

2. A terminal as claimed in claim 1, wherein the connection piece comprises a metal wire that is wound into a tapering helix, the wound wire forming the internal and external screw thread.

3. A terminal as claimed in claim 2, wherein the wire has a polygonal cross-section.

4. A terminal as claimed in claim 1 wherein the insulating jacket is at least partially dimensionally heat-recoverable.

5. A terminal as claimed in claim 1, which includes a quantity of sealant to prevent or reduce ingress of moisture into the shank from the region of the lug portion.

6. A terminal as claimed in claim 1, which includes a quantity of polymeric sealant located in an end region of the jacket of polymeric insulation that extends beyond the end of the shank to prevent or reduce ingress of moisture into the end of the shank where the wire or wires are inserted.

7. A terminal as claimed in claim 1, wherein the polymeric sealant is in the form of a gel.

8. A terminal as claimed in claim 1, wherein the jacket includes a metal ring that can be crimped about any wires that are inserted.

9. A terminal as claimed in claim 1, wherein the polymeric sealant is in the form of an insert of a fusible plastics material.

10. A terminal as claimed in claim 1, which includes a quantity of solder for forming a solder connection between the wires and the connection piece.

11. A terminal as claimed in claim 2, which includes a band of solder that extends around the connection piece and will flow through the windings of the helix when heated.

* * * * *

UNITED STATES PATENT AND TRADEMARK OFFICE

CERTIFICATE OF CORRECTION

PATENT NO. : 5,418,331

DATED : JACQUES DELALLE

INVENTOR(S) : May 23, 1995

It is certified that error appears in the above-indentified patent and that said Letters Patent is hereby corrected as shown below:

Column 3, Line 50, replace "my" by --may--.

Column 4, Line 21, replace ". element" by --element--.

Column 4, Line 21, replace "fore" by --form--.

Column 4, Line 22, replace "fore" by --form--.

Column 4, Line 23, replace "fore" by --form--.

Column 4, Line 32, replace "fore" by --form--.

Column 4, Line 40, replace "fore" by --form--,

Column 4, Line 41, replace "fore" by --form--.

Signed and Sealed this

Thirty-first Day of October 1995

*Attest:*

*Attesting Officer*

Bruce Lehman

BRUCE LEHMAN

*Commissioner of Patents and Trademarks*